US008890034B2

(12) United States Patent
Mishra

(10) Patent No.: US 8,890,034 B2
(45) Date of Patent: Nov. 18, 2014

(54) FIRE PREVENTION DEVICE USING SENSOR INPUT PARAMETERS

(76) Inventor: Birendra Kumar Mishra, Concord (CA)

( * ) Notice: Subject to any disclaimer, the term of this patent is extended or adjusted under 35 U.S.C. 154(b) by 601 days.

(21) Appl. No.: 13/265,483

(22) PCT Filed: Apr. 17, 2010

(86) PCT No.: PCT/IB2010/051680
§ 371 (c)(1),
(2), (4) Date: Jan. 2, 2012

(87) PCT Pub. No.: WO2010/122467
PCT Pub. Date: Oct. 28, 2010

(65) Prior Publication Data

US 2012/0132635 A1 May 31, 2012

(30) Foreign Application Priority Data

Apr. 20, 2009 (CA) ..... 2661514

(51) Int. Cl.
*H05B 1/00* (2006.01)
*G08B 17/00* (2006.01)
*G08B 29/00* (2006.01)

(52) U.S. Cl.
CPC ..... *G08B 17/00* (2013.01)
USPC ..... 219/209; 219/446.1; 340/506

(58) Field of Classification Search
None
See application file for complete search history.

(56) References Cited

U.S. PATENT DOCUMENTS

| | | | |
|---|---|---|---|
| 4,633,230 | A | 12/1986 | Tam |
| 4,659,909 | A | 4/1987 | Knutson |
| 5,717,188 | A | 2/1998 | Vaillancourt |

(Continued)

FOREIGN PATENT DOCUMENTS

| | | |
|---|---|---|
| CA | 2193533 | 12/1996 |
| CA | 2455665 | 1/2004 |
| WO | WO02063216 | 8/2002 |
| WO | WO2009021330 | 2/2009 |

OTHER PUBLICATIONS

International Search Report for PCT/IB2010/051680, Dec. 23, 2010, 3 pages.
Written Opinion for PCT/IB2010/051680, Dec. 20, 2010, 5 pages.

(Continued)

*Primary Examiner* — Shawntina Fuqua
(74) *Attorney, Agent, or Firm* — Reising Ethington P.C.

(57) ABSTRACT

'Firevoider' is a set of apparatus that combine and analyze electronic signals from Hall Effect sensors, current transformer, Pyroelectric infrared sensor, ionization chamber smoke sensor, to determine the imminence of fire hazard. On determination of the imminence of fire 'Firevoider' turns OFF the power to the range after pausing and sounding an alarm long enough to allow the cook to intervene. The various electronic circuitries are provided with stored charge powers back up to retain memory during power failures. In addition to the above features 'Firevoider' has a 'Timer Mode Cooking' feature that can automate cooking and save up to 40% power. 'Firevoider' does not interfere with cooking if the situation is safe or the cooking is attended. The apparatus for carrying out the various functions include, a smoke sensor to measure smoke level, a motion sensor that detects horizontal motion in the near vicinity of the range, a Hall sensor that measures power consumption by stove(s), a current transformer that determines the lower cut off level of power consumption by the range, a solid state relay to control power supply to the range, electronic circuitry to process signals, a set of two piezoelectric alarms to alarm the hazard status and indicate actions, a set of LED lamps to indicate various situations and status and suitable enclosure to accommodate the circuitry and sensing elements spread over four locations.

12 Claims, 9 Drawing Sheets

(56) References Cited

U.S. PATENT DOCUMENTS

| | | | |
|---|---|---|---|
| 6,130,412 | A | 10/2000 | Sizemore |
| 6,294,994 | B1 | 9/2001 | Hoellerich |
| 7,327,246 | B2 | 2/2008 | Schoor |
| 2005/0109333 | A1 | 5/2005 | Thomas |

OTHER PUBLICATIONS

International Preliminary Report on Patentability for PCT/IB2010/051680, Aug. 18, 2011, 3 pages.

FIREVOIDER

Frontal View of an Electric Cooking Range mounted with the Sensor Panel and Smoke Sensor mounted on the wall behind.

THE MAIN PANEL

SENSOR PANEL

Switches:
1. Reset
2. Timer Mode Cooking
3. Dense Smoke Override

Potentiometers:
4. Cycle After
5. Shut Down After
6. Power Level Set

Top View of Sensor Panel

Front View of the Sensor Panel

Side View of Sensor Panel

Back View of Sensor Panel

STOVE POWER SENSOR

Top View

Cross Section Through top View

Side View

Hall Sensor and Saddle

RANGE POWER CONTROLLER 1, 2, 3 PNP transistors 4, 5, 6, 7 NPN transistors

EXTREME, HIGH AND LOW HAZARD ANALYZER

STOVE POWER ANALYZER

RANGE POWER ANALYZER

MOTION ANALYZER

FIRE PREVENTION DEVICE USING SENSOR INPUT PARAMETERS

TECHNICAL FIELD

The present invention relates to an electronic fire safety device to prevent fires arising out of cooking activities, and more specifically, intended to greatly reduce the chances of fire that is likely to be caused when an electric cooking range that has been heating oil is inadvertently unattended.

BACKGROUND OF THE INVENTION

The following is an excerpt from a news item published by NFPA

Nov. 12, 2003—Year after year, hundreds of people are killed and thousands are injured as a result of one of humankind's most essential and pleasurable activities: cooking. The pursuit of a home-cooked meal remains the leading cause of home fires and fire injuries, according to new data from the NFPA (National Fire Protection Association).

'Cooking fires remain one of the toughest problems we face,' said John R. Hall Jr., Ph.D., of NFPA's Fire Analysis and Research Division. 'We have made less headway in preventing cooking fires than in preventing other kinds of home fires.'

Home fires have been declining-but those associated with cooking have been declining at a much slower rate. For example, home cooking fires declined by 29 percent from 1980 to 1999, but home fires in general went down by 49 percent. Deaths from home cooking fires declined 21 percent during that period, but total civilian home fire deaths dropped 44 percent. And while injuries from home cooking fires went down 7 percent in those two decades, total civilian home fire injuries fell 19 percent.

People often try to put out cooking fires on their own, and more than half of non-fatal cooking fire injuries occurred while fighting the fire. (That contrasts with total home fires, in which firefighting is involved in only one-third of non-fatal injuries.) With cooking fires, the safest response is not what may first come to mind using a fire extinguisher or applying water risk splattering and spreading the fire. A safer choice is to smother the fire by covering a pan with a lid or closing the oven door.

Reproduced from NFPA Web site ©NFPA (downloaded on 26 Jan. 2009).

My Invention 'Firevoider' is based on the following requirements that are expected of an Electric Cooking range Fire Safety Apparatus.

I have a great interest in the subject of safety. What I learnt is;

All safety devices are considered unnecessary bother and expense. Every body knows that incidents happen mostly when the person is careless. Some incidents that occur are beyond the control of humans and there are only a few devices that reduce their chance of occurrence. By being careful expense on safety devices can be avoided and that is what all will agree.

When I was 7 year old I wrote my grandmother a letter. I had a cold so I wrote about that to her. Before posting it my mother read it and had to put her comments on the letter. At that time, she told me that it was not proper to write about illnesses in a letter until it was grave. She told me such news can get my grand Ma and my uncle worried and that could lead to mental preoccupation and that such preoccupation can lead to fatal incidents. To conclude emotional situations cause mental preoccupation that can lead to incidents.

Under such circumstances safety devices can help avoid an incidence or reduce the chance of occurrence of an incidence. That is the reason in the field of safety it is assumed that the probability of accident can be reduced but not eliminated and that there is no boiler plate solution to avoid accidents.

On the other hand safety devices are bothersome to use. They will not be used if their disuse can be concealed. They will not be used if they cause inconvenience. To cut short it is not essential for the cook to pass a 'Pilot Aptitude Battery Test' to use a kitchen range fire safety device.

For any Kitchen Range Safety Device to be suitable for application at the domestic cooking range;

The device should be able to avoid fire under most circumstances

The cost of the device should be low

The device should be least noticeable

The look should be pleasing and large components should be concealable

Normal operation should be noiseless

Should be maintainable by layperson

Should not use batteries that may run out

Should not emit sound that would disrupt gossip or interfere with listening to the radio program or the TV Should not require immediate attention Should not require resetting without cause Should be intelligent enough to determine if the cook is mentally preoccupied Should allow the cook to cook smoking dishes Should not spoil thanksgiving dinner Should have some automation features, that will save enough time to compensate for the time spent in procuring it and looking after it Should be able to cook parboiled rice without interference Should not add to utility expenses and preferably be able to recover some of its cost by reducing utility expenses.

SUMMARY OF INVENTION

The present invention achieves its objective by pausing power supply to the range and sounding an alarm and subsequently shutting the range off.

The present invention works on existing Scientific Principles. It works on logics that have been specifically developed for its functioning and hence before proceeding further several references will be made to the following glossary of terms where each term will be discussed in detail.

GLOSSARY OF TERMS

Some terms used in 'Firevoider' are unfamiliar and of relevance to 'Firevoider' and hence a glossary is presented below;

TABLE 1

| | |
|---|---|
| Firevoider | The device for which the application for grant of patent is being made |
| Abandoned Cooking | The cook is absent for more than 10 minutes and has not set the Timer Mode Cooking |
| Cycle After Timer | User adjustable timer which is enabled by Timer Mode Cooking and determines the time after which range power is cycled to reduce range power consumption, the maximum time this can be set to is 20 minutes. |
| Dense Smoke Override | This feature allows the cook to disable the High Hazard functions for 10 minutes. |

TABLE 1-continued

| | |
|---|---|
| Extreme Hazard | When Smoke Sensor voltage is below 55% in absence of the cook |
| High Hazard | When Smoke Sensor voltage is below 55% for 5 seconds in presence of the cook |
| Hazard Clear | Smoke Sensor voltage above 85% |
| Low Hazard | When Smoke Sensor voltage is below 75% and cook is absent for 30 (+5) seconds |
| Main Panel | Intended to replace range power receptacle, contains power converter, circuitry for various functions of the 'Firevoider' (some of which may duplicate those in the Sensor Panel), the Sound Alarms, the Cooling Fan, Range Power Controller, Range Relay and its heat sink. |
| Oil on Stove | Smoke Sensor voltage below 90% |
| Power Level Set | This is enabled by the cycle after timer. When enabled it reduces the initial range power consumption to the set level. The maximum limit to which this level can be set is 50%. |
| Range Power Outlet | The electrical outlet to which the range is connected |
| Range Power Sensor | A current transformer that yields sufficient power to activate circuitry to enable power to the Sensor Panel thereby enabling the Motion Sensor, Smoke Sensor, Stove Power Sensor and associated circuitry when range power consumption is greater than 350 watts. |
| Range Power Controller | Controls power to range. Pauses power when required or commanded to. Shuts down when commanded to. It has Capacitor storage backup power that enables it to retain 'ON' state memory for up to 4 hours in the event of power failure. In absence of the 'ON' state memory 'Firevoider' will require resetting. However, when the memory is available, 'Firevoider' will need no resetting and Thanksgiving Turkey can keep roasting. |
| Range Relay | Electronic relay that acts as a switch to control power input to the Range |
| Reset Switch | Resets the 'Firevoider' and all functions to normal |
| Sensor Panel | Processes inputs from Motion Sensor, Smoke Sensor, Stove Power Sensor, and settings. Sends out put to LED, sound alarms, and the Main Panel |
| Sensor Voltage | The electrical potential difference of the plate (of ionization chamber of the Smoke Sensor) with respect to the ground connection. |
| Shutdown After Timer | Sets the total time the Range can remain on after Timer Mode Cooking is turned on. The range is up to 60 minutes and unlimited. |
| Smoke Sensor | A set of ionization chamber, electronic current amplifier, resistance and a 3 pin connector, housed in a suitable enclosure. |
| Stove Power Sensor | Hall effect Transducer. Senses power input to stoves and sends out put to Sensor Panel for further processing |
| Timer Mode Cooking | A switch that bypasses the abandoned cooking feature. It allows the user to set the Range on timer mode by adjusting the Cycle After Timer, Shutdown After Timer and Power Level Set potentiometers. This feature is reset every time the Stove power consumption drops to zero for 120 seconds. |

In one aspect, the present invention provides a device for regulating power to a cooking appliance, comprising: a control module interposed between an electrical power source and the appliance, the control module being operable to regulate electrical current to the appliance from the power source, wherein said electrical current regulation comprises at least one of reducing the electrical current, cycling the electrical current and cutting off the electrical current to the appliance; a smoke sensor positioned in a path of smoke generated during use of the cooking appliance, the smoke sensor being operable to measure a level of smoke indicative of a risk of fire; and a motion sensor operably positioned to detect one of human presence and human absence of an appliance operator; whereby, when the smoke sensor measures a first range of smoke level, electrical current regulation is not performed; whereby, when the smoke sensor measures a second range of smoke level and the motion sensor detects human absence for a first pre-selected period of time, the control module regulates the electrical current to the appliance; whereby, when the smoke sensor measures a third range of smoke level and the motion sensor detects human absence is detected by the motion sensor, the control module regulates the electrical current to the appliance; and whereby, when the smoke sensor measures the third range of smoke level and the motion sensor detects human presence for a second pre-selected period of time, the control module regulates the electrical current to the appliance.

In a further aspect, the present invention provides a device wherein the motion sensor comprises a pyroelectric infrared sensor and a fresnel lens having a vertical pattern; whereby horizontal motion integrated over 1 second being greater than 60% is interpreted as human presence and horizontal motion integrated over 1 second being less than 20% for a period of 5 seconds is interpreted as human absence.

In a further aspect, the present invention provides a device wherein the pyroelectric infrared sensor is configured for sensing 5 μm to 14 μm infrared radiation, the first pre-selected period of time being between 25 to 35 seconds, and the second pre-selected period of time being 5 seconds.

In yet a further aspect, the present invention provides a device wherein the smoke sensor comprises an ionization chamber smoke sensor having a pre-selected zero smoke level voltage; and wherein the first range of smoke level comprises a voltage drop range from the zero smoke level voltage being greater than 75%, the second range of smoke level comprises a voltage drop range from the zero smoke level voltage being between 75% to 55%, and the third range of smoke level comprises a voltage drop range from the zero smoke level voltage being less than 55%.

In still yet a further aspect, the present invention provides a device wherein the cooking appliance comprises an electric cooking range.

In yet a further aspect, the present invention provides a device further comprising an audible alarm, wherein said alarm is activated during the electrical current regulation.

In yet a further aspect, the present invention provides a device for regulating power to an electrical range cooking appliance, comprising: a control module for regulating electrical current to the appliance from a power source; a power sensor for detecting power consumption by the appliance, wherein the control module is activated when the detected power consumption is greater then a pre-selected threshold; a smoke sensor operably connected to the control module, the smoke sensor being configured to measure a first range of smoke level and a second range of smoke level; a pyroelectric infrared motion sensor operably connected to the control module and being configured to detect the presence of an appliance operator, wherein the motion sensor is operable to detect one of human presence being horizontal motion integrated over 1 second of greater than 60% amplitude and human absence being horizontal motion integrated over 1 second being less than 20% amplitude for a period of 5 seconds; wherein, the control module regulates the electrical current to the appliance when at least one of the first range of smoke level and human absence for a first pre-selected period is detected, the second range of smoke level and human absence is detected and the second range of smoke level and human presence for a second pre-selected period of time is detected.

In yet a further aspect, the present invention provides device wherein the motion sensor is configured for sensing 5 μm to 14 μm infrared radiation, the first pre-selected period of time being between 25 to 35 seconds, and the second pre-selected period of time being 5 seconds.

In still yet a further aspect, the present invention provides a device wherein the smoke sensor comprises an ionization chamber smoke sensor having a zero smoke level voltage; and wherein the first range of smoke level comprises a voltage drop range from the zero smoke level voltage being between 75% to 55%, and the second range of smoke level comprises a voltage drop range from the zero smoke voltage being less than 55%.

In yet a further aspect, the present invention provides a device wherein the motion sensor comprises a fresnel lens having a vertical pattern.

In yet a further aspect, the present invention provides a device further comprising an audible alarm, wherein said alarm is activated during electrical current regulation.

In still yet a further aspect, the present invention provides a device wherein the pre-selected threshold is 500 watts.

DETAILED DESCRIPTION OF THE DRAWINGS

DETAILED DESCRIPTION OF THE INVENTION

Smoke Sensor

Figure 1:
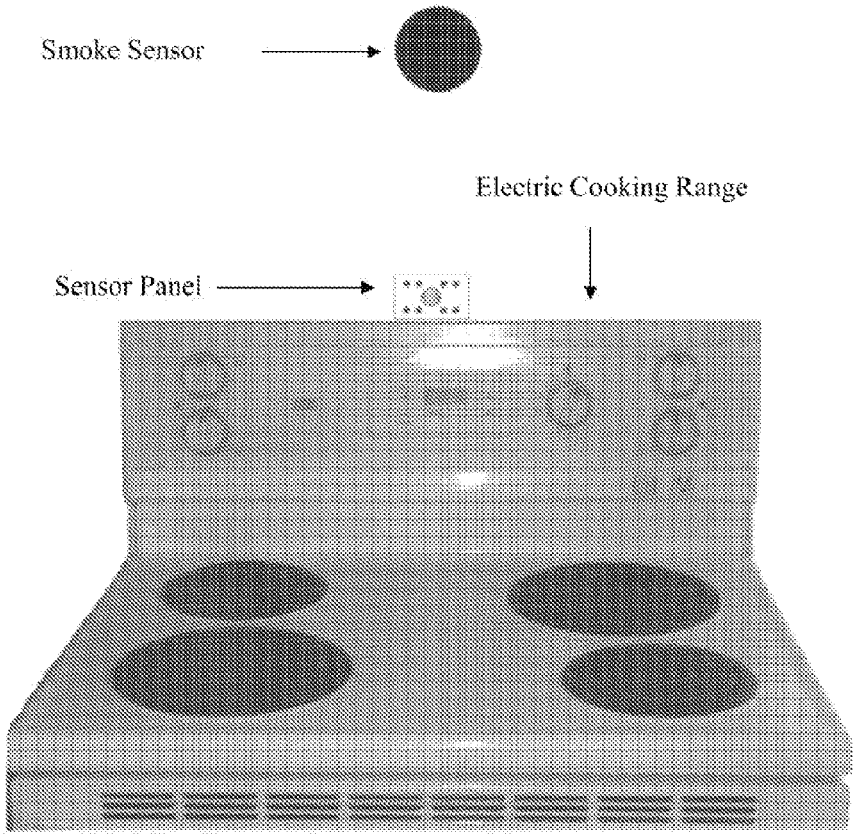
FIG. 1 shows a front perspective view of a first embodiment of the present invention.

The smoke sensor is an ionization chamber smoke sensor. The device is so adjusted that the (zero smoke) Smoke Sensor Voltage is 4.75 (+/−5%). An integrated circuit amplifies the current and the output is sent to the Sensor Panel.

The Smoke Sensor is intended to be placed in the path of the smoke. In most cases it is possible to obtain smoke samples in adequate quantities by anchoring the smoke sensor to the wall behind the range centered with respect to the range hood exhaust filter and close to the filter.

It is connected to the Sensor Panel which provides it with 9 volt DC power and analyzes the Smoke Sensor Voltage.

Sensor Panel

Sensor panel is an 'L' shaped box mounted on the back panel of Cooking Range as shown in the FIGS. 4, 5, 6, and 7. This panel contains stove power analyzer (figure: A16), motion analyzer (figure: M18), and smoke level analyzer (figure: A19), a charge pump to power the Smoke Sensor at 9 volt, and electronic circuitry for Timer Mode Cooking and various other circuitries for the functioning of the device 'Firevoider'.

Sensor panel is connected to the Stove Power Sensor

Stove Sensor output is interpreted by the stove power analyzer (FIG. 16) as defined below;

A comparator circuit is enabled by a stove (s) power consumption of 500 Watts or greater.

A stove (s) power consumption of 500 Watts or greater turns a red LED 9 'ON' indicating that stove (s) power consumption is greater than 500 Watts.

The comparator out put is fed to various logic circuits at the Sensor Panel and the Main Panel.

Sensor Panel is connected to the Smoke Sensor.

Smoke Sensor output is interpreted by the smoke level analyzer (FIG. 19) as defined below; 100% to 85% Smoke Sensor voltage is interpreted as safe and output is fed to the green LED 7 on the Sensor Panel.

Less than 90% Smoke Sensor voltage is interpreted as low smoke and the output is fed to the amber LED 8 to indicate Oil on Stove. This is slightly more sensitive than most smoke detector would call a smoke (all house hold smoke detectors detect presence of smoke above 85% of smoke sensor voltage and sound the smoke alarm).

Smoke Sensor Voltages lower than 75%, this is the level where smoke may be visible, are interpreted as medium smoke and as a hazard. The output is sent to a red LED 11 on the Sensor Panel and to the Main Panel. The circuitry comes adjusted as 75% Smoke Sensor voltage by default however, since the configuration of the kitchen influences this value an adjustment regulator on the sensor panel allows the user to set the value to a lower 70% value and thus avoid false alarms.

Smoke Sensor voltages lower than 50 to 55% (this type of smoke is visible and is the smoke that appears at around the smoke point of almost all cooking oils) is interpreted as dense smoke and a high hazard. The output is sent to a red LED 12 in the sensor panel and to the Main Panel. The circuitry comes adjusted to 55% Smoke Sensor Voltage, for not all cooking oils have the same property. For example Palm oil has a very small difference (less than 20 degrees Celsius) between its smoke point and Flash point and this necessitates that dense smoke be recognised as early as possible. By default the set comes preset for Palm oil i.e. to sense dense smoke at 55% Smoke Sensor voltage. An adjustment regulator on the Sensor Panel allows those that do not use palm oil and cook near the smoke points to adjust the sensing levels to 50% and avoid false alarms.

Sensor Panel Switches and Potentiometers

Figure 4:
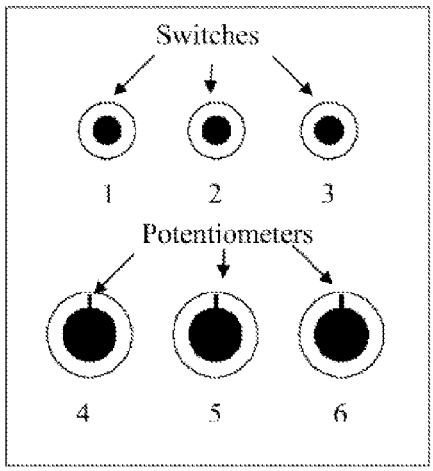
FIG. 4 shows a top perspective view of a sensor panel in accordance with the present invention

On top of the Sensor Panel there are 3 switches and 3 potentiometers as shown in FIG. 4

Switches

Reset Switch resets the Firevoider and all functions to normal

Timer Mode disables abandoned cooking circuitry and enables Timer Mode Cooking function. It turns on an amber LED 10 on the Sensor panel and also turns on the 60 decibel sound indicator located in the Main panel.

Dense Smoke Override disables dense smoke output for 10 minutes in human presence and enables the 60 decibel sound indicator located in the Main Panel.

Potentiometers

Cycle After Timer this timer is a graduated potentiometer that sets the time after which power is cycled to reduce power input to heaters. This timer has a maximum limit of 20 minutes. The Timer out put is sent to the power level set circuitry.

Shutdown After Timer this timer is a graduated potentiometer that sets the time after which the range power is shutdown. It is graduated up to 60 minutes and a setting to bypass the timer and keep the circuit active for unlimited time.

Power Level Set this is a graduated potentiometer that determines the level of power at which the Range would operate after the Cycle After Timer enables cycling. The maximum level that the power level can be set to is 50%.

The above feature is expected to reduce wastage of electric energy and result in a saving of up to 40% thus offsetting the energy consumption of the 'Firevoider'. Firevoider is expected to consume about 5 kilo Watt per year.

Sensor Panel House the Following Circuitry

Timers for Dense Smoke Override, Cycle After Timer, Shutdown After Timer and an a stable multi-vibrator for cycling power.

Figure 16:
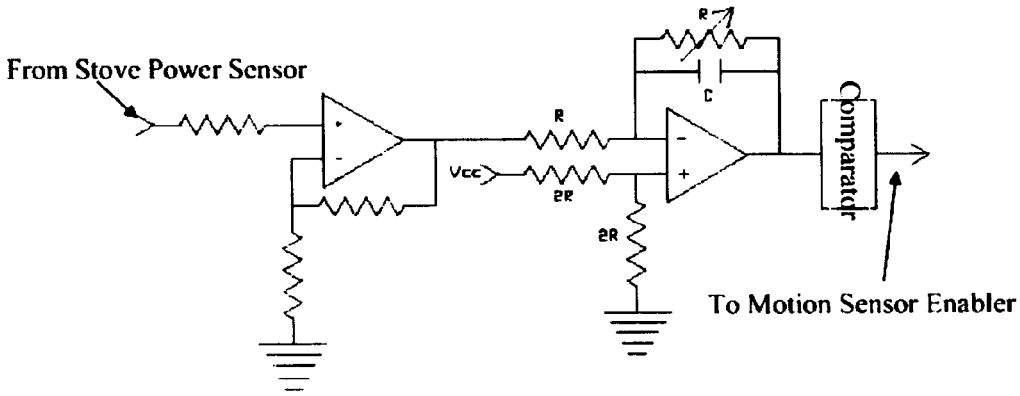
FIG. 16 shows a schematic illustration of the circuitry of a stove power analyzer in accordance with the present invention.

Stove power analyzer (FIG. 16)

Circuitry to disable Abandoned Cooking feature

Figure 19:
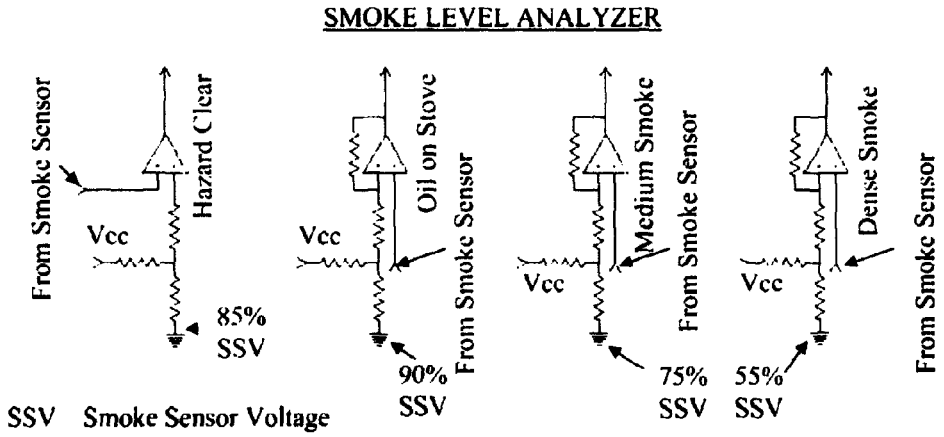
FIG. 19 shows a schematic illustration of the circuitry of a smoke level analyzer in accordance with the present invention.

Smoke level analyzer (FIG. 19)

Figure 18:
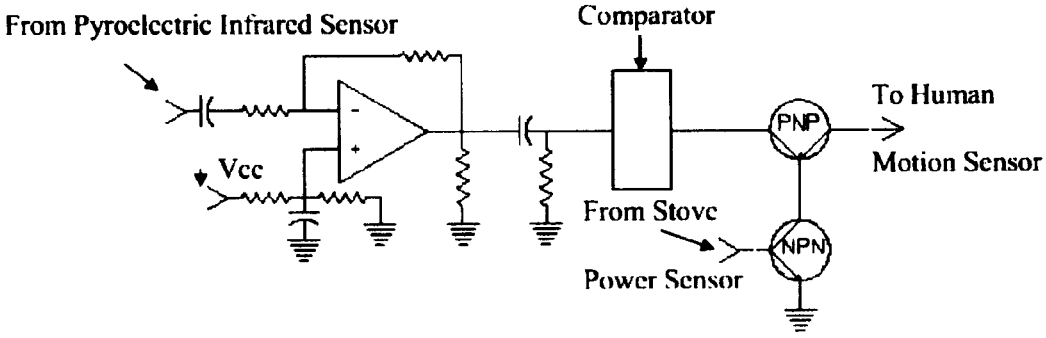
FIG. 18 shows a schematic illustration of the circuitry of a motion analyzer in accordance with the present invention.

Motion analyzer (FIG. 18)

Circuitry to manage LED indicators

Sensor Panel is connected to the Main Panel

Motion Sensor

The Motion Sensor is part of the Sensor Panel

The Motion Sensor is a human motion sensing device that senses infrared radiation from human body and suitably interprets them as defined below.

Figure 2:
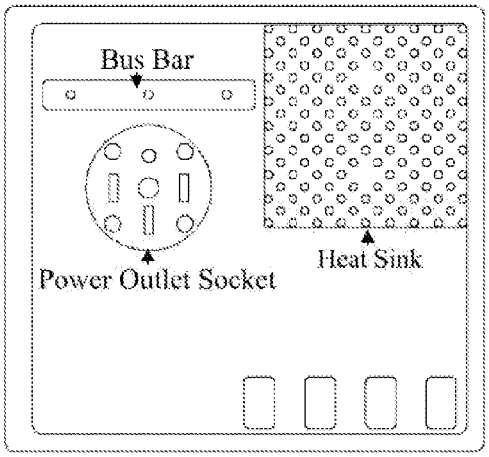
FIG. 2 shows a front elevation view of a main panel in accordance with the present invention.
Figure 5:
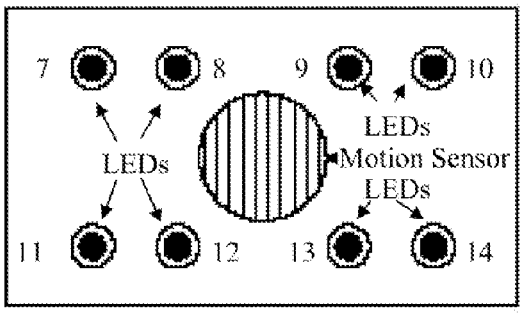
FIG. 5 shows a front elevation view of the sensor panel shown in FIG. 4.
Figure 6:
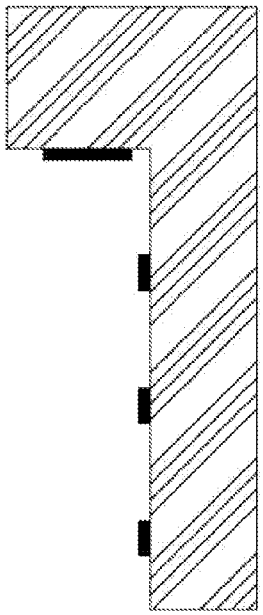
FIG. 6 shows a side elevation view of the sensor panel shown in FIG. 4.
Figure 7:
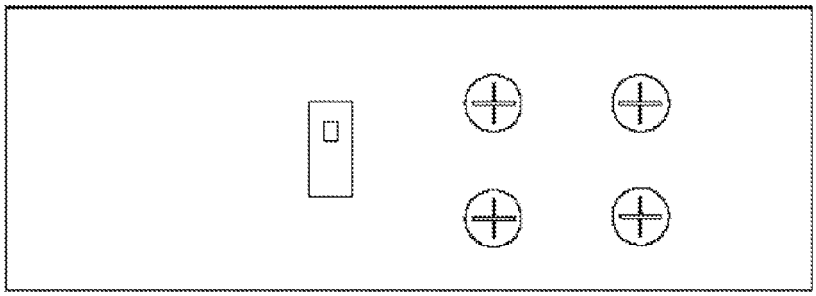
FIG. 7 shows a rear elevation the sensor panel shown in FIG. 4.
Figure 8:
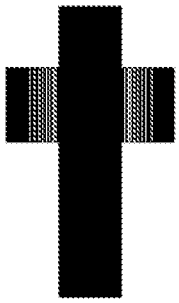
FIG. 8 shows a top plan view of a stove power sensor in accordance with the present invention.
Figure 9:
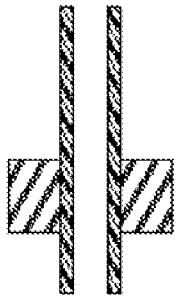
FIG. 9 shows a top cross-sectional plan view of the stove power sensor shown in FIG. 8.
Figure 10:
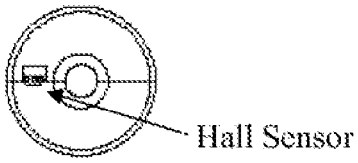
FIG. 10 shows a side elevation view of the stove power sensor shown in FIG. 8.
Figure 11:
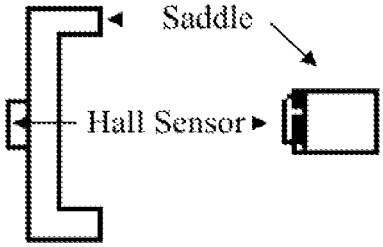
FIG. 11 shows an enlarged view of the Hall Sensor and Saddle assembly in accordance with the present invention.

The Motion Sensor comprises of a Pyroelectric Infrared Sensor (optimized for sensing 5 t m to 14 t m infra red radiation) placed behind a Fresnel lens with only vertical patterns (FIG. 5). The motion analyzer (FIG. 18) circuitry is located in the Sensor Panel. The output from the motion analyzer is sent to the Human Motion Sensor Logic (FIG. 13) located in the Main Panel (FIG. 2).

The Human Motion Sensor Logic

Figure 13:
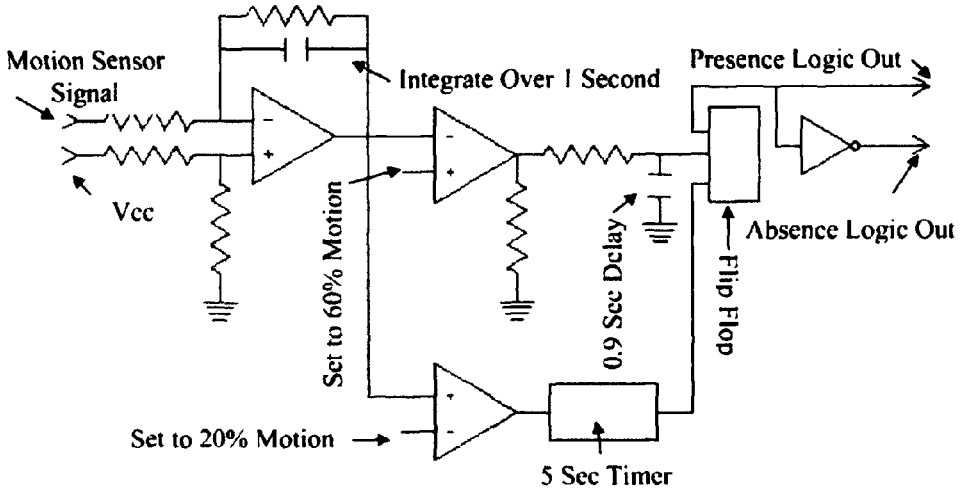
FIG. 13 shows a schematic illustration of the circuitry of the human motion sensor logic in accordance with the present invention.

The circuitry is located in the Main Panel (FIG. 2) and is shown in FIG. 13

The Motion Sensor is designed to sense horizontal motion within about 2.5 meters from the Sensor Panel.

Human motion or any moving source of infrared (wavelength of 5 to 14 micrometer) of sufficient amplitude, moving in a horizontal direction such that the total activity integrated over 1 second is greater than 60% is interpreted as human presence. Such signal is delayed by 0.9 seconds to avoid errors and transients. Human motion of less than 20%, integrated over 1 second, is interpreted as human absence.

Human presence data is held until a continuous human absence for 5 seconds is detected by the circuitry. Human absence data will be voided by human presence as defined above.

This procedure, as observed during trials, reduces chances of false alarms and thus a lesser possibility of 'Firevoider' becoming a nuisance. Also it was observed during trials that human behaviour is such that, when emotionally engrossed the bodily motion reduces much below 20% and these are the times when attention to work and surrounding's are the lowest. So even when the person is physically present but mentally absent 'Firevoider' measures it as human absence.

Stove Power Sensor

The apparatus includes a Hall Effect current sensor. Various elements of this sensor are shown in FIGS. 8, 9, 10, and 11.

This sensor called the 'Stove Power Sensor' is intended to be installed by the user. This sensor is clamped on one of the phase wires connecting the stoves. The sensor is installed on the wire after the power distribution bus bar inside the back cover of the Range.

This installation is expected to be done by a knowledgeable (professional) person with the Range plug disconnected from power supply.

A second sensor, which is a current transformer is factory installed inside the Main Panel. This sensor outputs enough power when Range Power Consumption is greater than 350 Watts to enable the DC power supply that powers the Sensor Panel circuitry. Since cooking is done for about 500 to 1000 hours a year this feature is expected to result in savings of up to 20 kilo Watt of energy annually.

When the Stove sensor is not installed and the mode switch on the Main Panel is set to all or on the Sensor Panel to Stove Power Sensor not installed, 'Firevoider' interprets Range power consumption 350 Watt (Nominal) or greater as stove power consumption.

In either of the above cases Range Power consumption greater than 350 watts enables the DC power supply (FIG. 15) that powers the Sensor Panel circuitry and keeps them enabled for 120 seconds after the range is turned off The Main Panel The Main Panel (FIGS. 2 and 3) is a box intended to replace the Range Power Outlet.

Only Qualified (Professional) Electricians may replace the Range Power Outlet by the Main Panel.

The Main Panel has a depth no more than 60 millimeters and 200 to 260 mm long and 200 to 260 mm wide. The length and width of the box will depend on the maximum ambient temperatures of the geographic location of intended use, the smaller sizes being intended for ambient maximums below 25 degree Celsius and the highest being for ambient temperatures ranging to 50 degree Celsius.

The Main Panel houses the

Electric Distribution Bus Bar (FIG. 2) this bus bar is intended to be a power distribution point. To this bus bar is connected the power input and from this bus bar are connected the parallel connection to the existing range power outlet and to the relay and range power outlet on the Main panel.

Range Relay controls power supply to one of the phases in case of dual phase 115 Volts alternating current mains supply (or the phase in case of single phase 240 Volts mains power supply). The Range Relay is a SCR Relay of at least 60 Ampere power rating and controlled by less than 24 volt DC switching voltage. It is mounted on a fan cooled heat sink appropriate for the climatic conditions of the geographic location of intended use.

Figure 15:
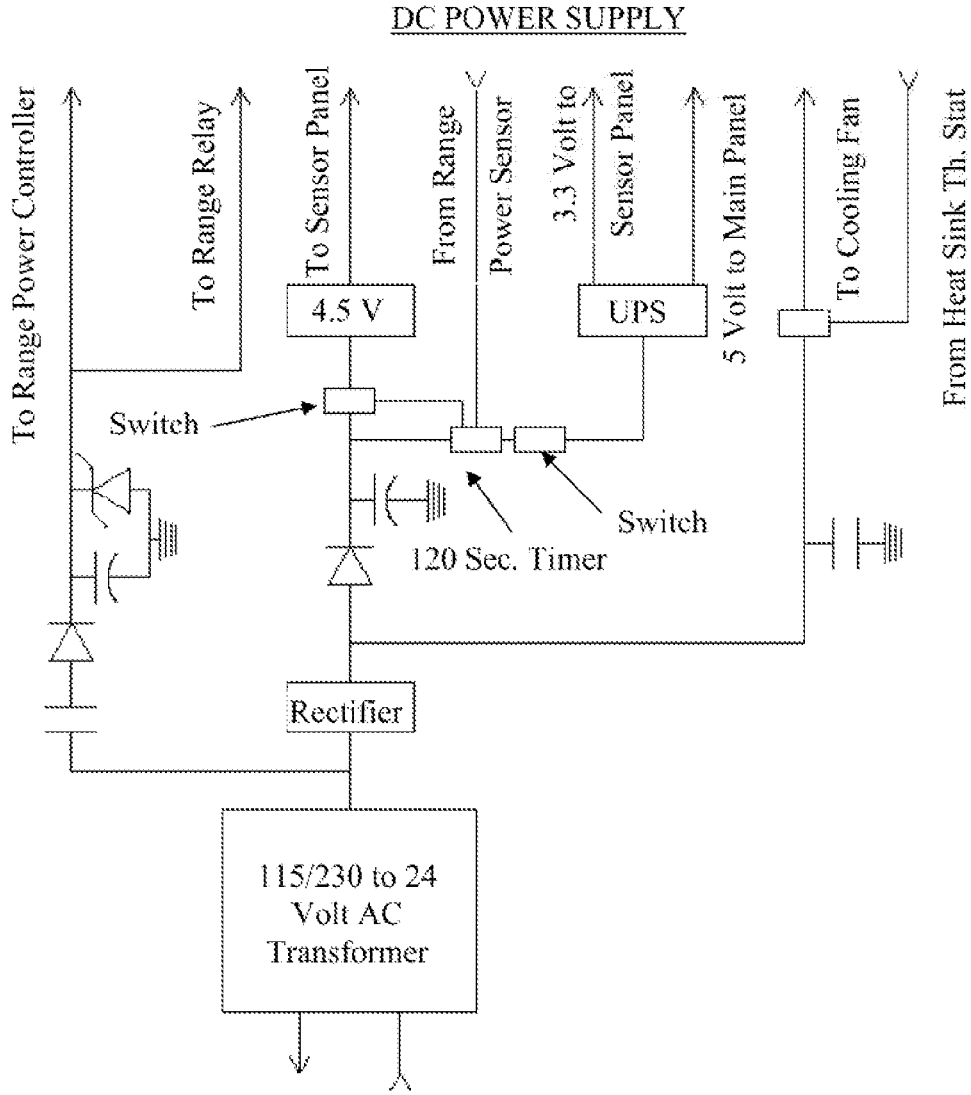
FIG. 15 shows a schematic illustration of the circuitry of a DC power supply in accordance with the present invention.

The Main Panel houses the fan switching circuitry (FIG. 15).

The Main Panel houses the heat sink temperature sensor which pause power supply on over heating of the Relay and thus avoids failure due to burnt out relay.

The Main Panel has a 4 point 60 ampere power socket (FIGS. 2 and 3), for 115 volt mains power as is prevalent in Canada and the United States of America, or a 3 point 60 Ampere power socket, for 240 Volts single phase power supply as is prevalent in most parts of the rest of the world.

Although the Main Panel is intended to replace the Range Power Outlet there can exist situations where the user would prefer not to replace the Range Power Outlet. In such cases the user can connect the Main Panel to the existing range power outlet using a standard (appropriate) electric cord. The Main Panel in such uses may be placed at a suitable location near the cooking range.

Figure 3:
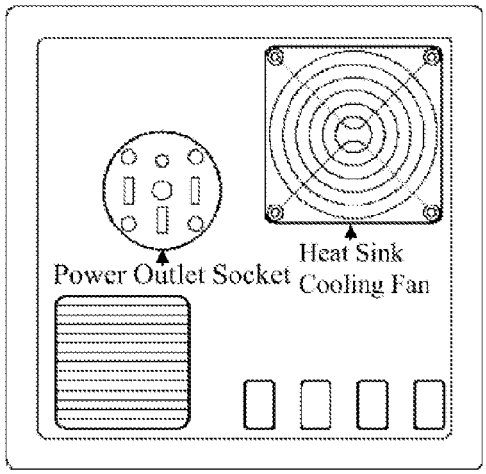
FIG. 3 shows a front elevation view of a main panel in accordance with the present invention

The Main Panel has the Range Relay heat sink cooling fan mounted in front of it (FIG. 3).

Figure 12:
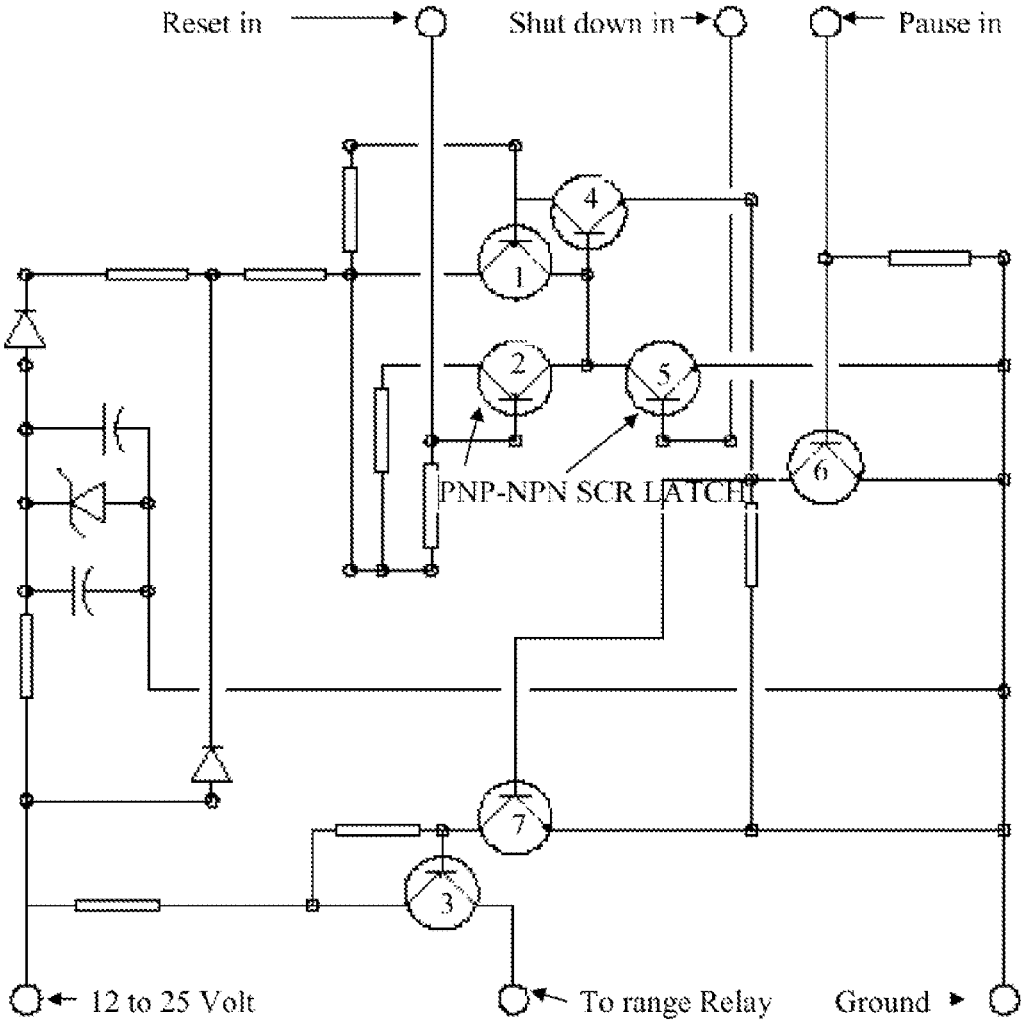
FIG. 12 shows a schematic illustration of the circuitry of a range power controller in accordance with the present invention.

Range Power Controller (FIG. 12)

The Range Power Controller circuitry has the following functions

On receiving pause signal the power supply to the Range Relay is paused and thus power supply to the range is cut off.

On receiving shutdown command it turns 'OFF' a set of PNP and NPN circuitry that act as discrete Silicon Controlled Rectifier and thus power supply to the relay is disabled. The relay in turn shuts the cooking range off.

This set of SCR is backed up by super capacitor charge storage devices. A very low power consuming circuitry whose power consumption is limited by the leakage currents of the Super Capacitor and the transistors.

The charge storage super capacitor is so chosen that at its minimum the circuitry remains energised for at least 4 hours in the 'ON' state.

'OFF' state power consumption is limited by leakage current through the transistors and hence difficult to predict. However, the circuit is designed as an SCR and the start up and shut down transistors are PNP and NPN wired collector to collector so that leakages can not build up switching voltages in combination with statics that might escape the shield. Hence the circuit has a very low chance of turning on (malfunction) without human intervention once turned 'OFF' due to a shutdown command or due to long power failures resulting in the storage capacitors running below the lower threshold voltages.

This circuit is capable of taking commands during power failures as well and before the capacitors run out.

Figure 17:
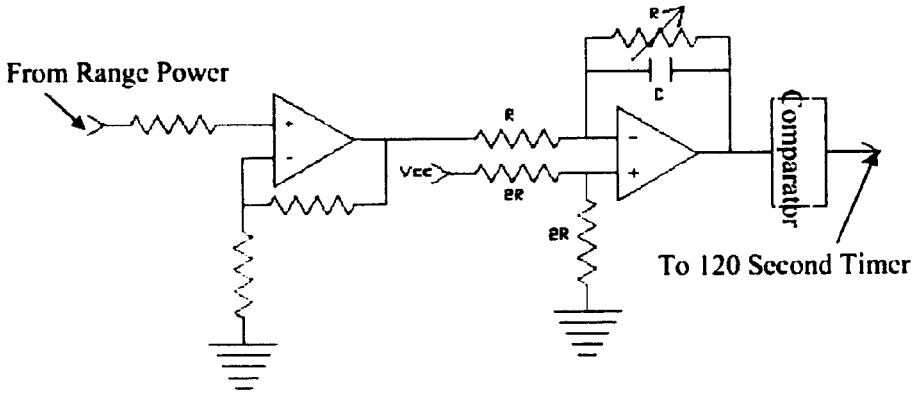
FIG. 17 shows a schematic illustration of the circuitry of a range power analyzer in accordance with the present invention.

The Main Panel houses the electronic circuitry necessary for the following functions as described below;

The range power analyser (FIG. 17) is a set of amplifier, integrator, and comparator that receives signals from the Range Power Sensor (a toroidal current transformer through which is passed the wire connecting the Range Relay to the electric distribution bus bar) that enables a 120 second timer when the power consumption of the cooking range exceeds 350 Watt.

DC Switching Power Supply (FIG. 15) with outputs of 24, 3.3, 4.5 and 5 volt regulated voltage. This power supply is a high efficiency traditional transformer rectifier or switch mode power supply with 24 volt output. 3.3, 4.5 and 5 volt regulated voltages are developed by buck regulators. The power supply for the range Power Controller and Range Relay are drawn through a capacitor from the transformer (through a buck regulator in case of switch mode power supply) It has large enough capacitors storage to keep the power supply alive during power transients of less than 2 seconds.

Uninterrupted Power Supply (UPS) (FIG. 15) this circuitry is enabled by greater than 350 watt range power consumption. In the event of a power failure the buck regulators generate 3.3 and 5 volt regulated DC for up to 110 seconds.

Abandoned Cooking (Timer Mode Cooking Disables this Feature)

Cook is absent and power consumption by stove(s) is greater than 500 Watt (the range power consumption greater than 350 Watt in the event that the Stove Power Sensor is not installed) and time elapsed greater than 10 minutes out put is sent to a set of circuitry consisting of an a-stable multivibrator and 4 bit counter.

On receiving abandoned cooking signal power supply is paused for 45 seconds. After power pause the power is restored for 30 seconds. 4 such cycles later the power supply is shut down.

The intent of this feature is to alert the Cook who might have gotten busy with some work or who might be attending to the calls of nature about the state of cooking that he/she might have forgotten. Most often aqueous food comes to boiling point in less than 10 minutes and thereafter it needs little power to remain at boiling. All the same since the heat level is only reduced and after 10 minutes the chances that food items like Brinjal (Egg Plant) might go cold and spoil the dish is very low.

If oil was left on the stove it is very likely that it will have smoked and the smoke been detected and appropriate action taken.

Abandoned cooking feature is not meant to replace Extreme Hazard, High Hazard and Low Hazard features.

If during the execution of the Abandoned Cooking procedure Extreme Hazard or Low Hazard situations arise then their respective procedures as defined in the respective sections will take precedence. For example if dense smoke is detected then the power will be paused for 15 seconds and Range turned 'OFF' thereafter.

To keep costs low backup power is not available to the sensor elements and the logic circuitry for longer than 110 seconds. And hence the circuitry will not be able to sense human presence during power failures exceeding 110 seconds. In this event Abandoned Cooking procedure will be abandoned after the capacitors run out. Since there is enough charge for Extreme Hazard and Low Hazard procedures, they will proceed to completion. On some, very rare, occasions it can inconvenience the user however, the intent is to avoid a fire hazard.

Figure 14:
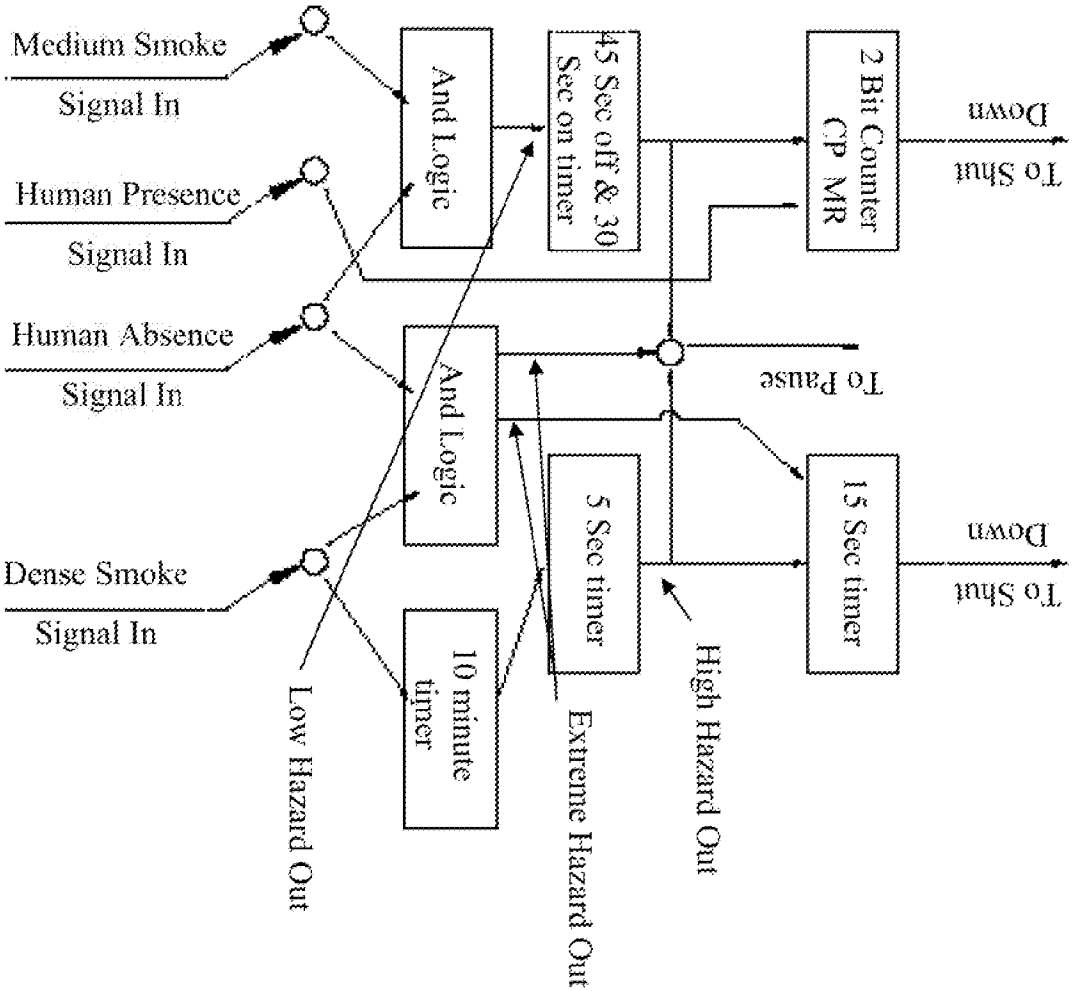
FIG. 14 shows a schematic illustration of the extreme, high and low hazard analyzer logic in accordance with the present invention.

Extreme Hazard (FIG. 14) dense smoke signal and human absence signal are sent to an 'And Logic'. This output is sent to a 15 second timer and to the pause input of the Range Power Controller. The output from the 15 second timer is sent to the shutdown input of the Range Power Controller.

Extreme Hazard feature is always active that is whenever the Range starts consuming power greater than 350 Watt.

High Hazard (FIG. 14) dense smoke signal is sent to a 10 minute timer. When this timer is not activated the dense smoke signal is sent directly to a 5 second timer. The out put from the 5 second timer is sent to a 15 second timer and to the pause input of the Range Power Controller. The out put from the 15 second timer is sent to the shutdown input of the Range Power Controller.

Signals are blocked when the 10 minute timer is active. Thus when the Dense Smoke Override switch is set High Hazard action is disabled for 10 minutes.

Low Hazard (FIG. 14) medium smoke signal and human absence signal are sent to an 'And Logic'. This output is sent to a 45 seconds 'OFF' and 30 second 'ON' a-stable multi-vibrator. The out put from this a-stable multi-vibrator is sent to the pause input of the Range Power Controller and a 2 bit counter. The out put from the 2 bit counter is sent to the shutdown input of the Range Power Controller.

Human presence signal clears the memory of the counter and thus resets it to normal.

Sound Alarms and Indicators

Pause commands from Abandoned Cooking, Extreme Hazard, High Hazard and Low Hazard activate an audible alarm whose amplitude is 80-decibel. This alarm remains 'ON' during the pause period only. This alarm is not available during power failures.

Every shutdown of the range is accompanied by an audible alarm whose amplitude is 60-decibel. This alarm is also activated by Timer Mode Cooking. This alarm is not available during power failures.

Discovery of the transistor was followed by several solid state devices. Notable among them is the Solid State Relay. Solid State Relay invented in late 1960's are a common place now Unlike the electro mechanical relay this relay is compact and soundless, besides it has almost unlimited life.

Several trigger controlled interrupters are being designed, built and marketed, based on the convenience of this new invention. Some relevant triggered devices are; remote controlled air conditioners and space heaters, motion activated door openers, smoke triggered shut off of microwave ovens.

Several patents have been applied for or issued by the Canadian Intellectual Properties Office, United States Patent Authority and World Intellectual Property Organization, for warning and isolating Cooking Ranges on receipt of a trigger from burglar alarm (motion sensor), temperature detectors and smoke detectors.

All these inventions are based on detection of presence of smoke or detection of presence of motion (both of which have been in use for long). Some of the inventions refer vaguely to signals and fail to define the parameters. In contrast 'Firevoider' is programmed to measures the level of power, the level of smoke and that of motion and combine them to make decisions akin to human logic. It allows the Cook to carry on cooking activity and as he/she pleases, as long as he/she is in command. If the cook decides that the situation is safe and he/she is the commander 'Firevoider' obeys the command as long as the Cook is in Command.

Reference is made to the following patents and patent applications in the following discussions;

COOKING, FIRE, AND BURGLAR ALARM SYSTEM, U.S. Pat. No. 4,633,230 issued on 30 Dec. 1986 to Wee M Tam FIRE PREVENTION DEVICE FOR ELECTRIC COOKING STOVE, Canadian unexamined patent application #2193533 by inventor RAK, ZOJEF KITCHEN RANGE SAFETY SHUTOFF, U.S. Pat. No. 4,659,909 issued on 21 Apr. 1987 to Arthur E Knutson METHOD AND APPARATUS FOR REMOTELY CONTROLLING DEVICES IN RESPONSE TO A DETECTED ENVIRONMENTAL CONDITION, U.S. Pat. No. 6,130,412 issued on 10 Oct. 2000 to Charles Timothy Sizemore SAFETY SHUT-OFF SYSTEM, Canadian unexamined patent application #2455665 inventor Schoor, Wolfgang SAFETY SHUT-OFF SYSTEM, U.S. Pat. No. 7,327,246 B2 issued on 5 Feb. 2008 to Wolfgang, Schoor CONTROLLER FOR A SAFETY SHUT-OFF SYSTEM, World Intellectual Property Organization—International publication #WO2009/021330 A1 AND International Application #PCT/CA2008/001462, Inventor BUTT, Marvin D.

The patents using signals from motion sensors, and smoke sensors ('Firevoider' uses motion sensor and smoke sensor) are mentioned and their shortcomings vis-à-vis the logic and functioning of the 'Firevoider' is discussed below under the relevant patents.

Patents Using Signal from Motion Sensors

The following two patents are based on signals from motion sensors

COOKING, FIRE, AND BURGLAR ALARM SYSTEM, U.S. Pat. No. 4,633,230 issue date 30 Dec. 1986, Issued to Wee M Tam In this discloser; a discloser is made to detect fire or impeding fire by means of measuring the temperature of the cooking pots lid. Also disclosed is the use of a burglar alarm to detect human presence.

On detection of imminent fire the system sounds an alarm.

Although a very good attempt had been made the disclosure concentrates on a temperature measuring device made of Silicon.

The device seems to intend to manufacture a product that can sound an alarm and warn a human although it is not exclusively claimed.

On some occasions the human could have been preoccupied with other activity to forget the cooking and may be in a position to attend to the alarm however, on occasions that he was out of the house or incapable of attending the range there is no method of isolating the power.

FIRE PREVENTION DEVICE FOR ELECTRIC COOKING STOVE Canadian Unexamined Patent #2193533, Inventor Rak, Zojef (now dead application) discloses a method of turning 'Off' power to the unattended electric cooking range after a preset time of sensing absence of motion. This invention most likely adapts a burglar alarm motion sensor to accomplish the object. It discloses how the burglar alarm should be positioned and where it should be positioned. It also discloses wiring and circuitry to measure motion and time and turn off the Range after a preset time. It also discloses that on arrival of the cook the power is automatically turned on.

In these 2 patents;

Most modern motion sensing devices can distinguish between adult human motion and motion by beings less than 40 pounds heavy. A problem with measuring motion is to determine weather the motion was a valid motion by an adult attending the cooking activity on a Range.

As has happened with me during running the trial for 'Firevoider' (to determine the parameters)—the oil on the pan was ignited for 1 got busy studying a drawing of the 'Firevoider' and that distraction was long enough to ignite the oil on the pan. All along I was physically in front of the stove but mentally absent.

A couple of years ago in Quebec a very tragic incident occurred; a mother had put oil on the range to fry French Fries for her children and probably was attending to calls of nature (or unknown to me mentally absent) when the oil caught fire. She probably did not feel comfortable with the burning fire and also probably did not want to create a mess by dumping the oil in the kitchen sink and decided (probably) to dump it in the toilet and on her way she spilled the burning oil and set the house on fire. The man and the lady of the house escaped—not the children.

Such an incidence has occurred at my home also. My wife had put oil on the pan to poach an egg and for some reason was not very attentive and the oil overheated and ignited. All along she was in front of the range we were lucky for the quantity of oil was small.

Over the past one and half decades a relative of mine has set her house on fire at least on 3 occasions. All the three times it was an emotional day and all the time she had put butter on stove to clarify it and was in the house (not far from the stove) but busy otherwise.

So a thorough analysis of the motion detection yield

That when a person is physically present but mentally absent his/her motion is typically less than 20% integrated over a second.

When a person is mentally and physically present and attentive her/his motion is greater than 60% integrated over a second and delayed by 0.9 seconds (this logic effectively requires presence of 60% motion over the $1^{st}$. second as well as for 60% of the $2^{nd}$. second).

The 'Firevoider' Motion Sensor lens is adjusted to measure motion at or less than 2.5 meters from the back of the Range and included angle less than equal to 90 degrees. This arrangement will in most cases fail to measure motion by a pet (large heavier than 40 pounds) and or a child near the range whose motion is measured as 60% integrated over a second and delayed by 0.9 seconds. This method of motion measurement greatly reduces the chances of misdetection. During trials (with this method of measuring motion) I observed that quite often merely appearing in front of the range and within the viewing area of the motion sensor is not enough to cause the motion sensor to detect presence of the cook. Many times I had to shake my hand to make my presence felt. Of course, appearing in front of the range and getting busy with cooking activity was detected as presence.

The absent timer is time delayed by 5 seconds so any physical activity in front of the range, after the presence logic has been enabled cancels the absence detection (of short durations). This avoids false alarms that can frustrate the user.

The motion sensor lens and detector are placed on the rear pillar of the cooking range. When cooking is being done large volumes of gas at about the human body temperatures move (generally) upwards. Although these emit heat waves at the same frequency range that humans emit, their power is very low for the density of air is much lower than that of human. The motion sensor sensitivity is set to the lowest feasible level. Also the Fresnel pattern on the lens is made vertical only so that only horizontal motion can be sensed by the sensor. Most gas movements being vertical it is less likely that they may interfere (during observations they have not) with the motion detection process.

It would be a nuisance in the event the cook had set the timer on and after expiry of the time the range turned off without giving a long enough warning. It would also be greatly inconvenient if the range was turned off after a preset time and the turn off ruined the dish (Vegetables like Egg Plant or Brinjal taste horrible if during the cooking period the temperature goes below boiling point of water or approximately about 95 degrees Celsius). Cake in the range will invariably go bad if turned off for a period of greater than 2 minutes (The cycling is about 40% 'On' and 60% 'Off' on a 2 kilo Watt oven).

All the above mentioned situations and many more situations were considered and analyzed to come up with the Motion Sensing Logics of the 'Firevoider'.

During experimentation it was observed that;

Various oils heated to smoke point and sprinkled on hot stove elements failed to ignite when 8 inch (2000 Watt) stove was consuming less than 1300 Watt 6 inch (1000 Watt) stove was consuming less than 650 Watt Also at these power levels the stoves failed to ignite oil soaked rags. However, oil soaked rags and oil sprinkled on the elements gave out oil vapours. These vapours are gray in color and could not be ignited even with a lighted oil torch.

To be on safe side it was concluded that 50% power level is a safe level.

Several observations at 50% power level confirmed that hot oil spilled on top of the element from frying pans would not ignite. Also observed was the fact that food cooking in the pan at these power levels would not char.

Cooking in the oven invariably does not need attention. Besides until the oven was used for storing used oil in pans and was inadvertently turned on chances of a fire arising from the oven and spreading is near non existent. The flames are contained within the oven and if the amount of oil was not large enough the flame heights will be low enough not to spread to the other parts of the kitchen and the dwelling.

Hence, there is no point monitoring for a hazard which has a very low probability (if any) of existing. Hence, 'Firevoider' does not monitor for motion if the range top stove(s) consume less than 500 Watt power. It would have been better if it would have become practical to measure and monitor power consumption of each stove, with a standalone device, (only Cooking Ranges built with 'Firevoider' as an integral component can monitor individual stoves). However, only on very rare occasions will a person get busy otherwise after turning on more than one stove and for long. Cooking is not just putting a pot with water or oil and turning it on. A second stove means another dish and there is plenty of work to be done before that goes on the stove and by the time the second goes on the stove the first dish will be done or if it was heating oil for flying, the oil will be hot enough to fry. Hence the cooking will invariably be attended.

There are quite a number of dishes that need to boil for long. That is they need high power to come to boil and very little power thereafter. Experiments were done to determine various parameters and it was found that;

A 2 liter aluminum pan, wall thickness 3 mm or so with 1.25 liters of water and food takes about 8 minutes from cold to come to boil at 1000 Watt and thereafter if uncovered keeps boiling at 350 watt and if covered at about 100 watt. Such quantities in a 2 liter thin walled stainless steel pan will keep boiling uncovered at 350 watt and if covered at 200 Watt.

1. 5 liters of broth in a 4 liter stainless steel pan will keep boiling (Uncovered) at 500 Watts on a 1000 Watt stove. An 8 liter aluminum pot with 7½ liters of food and covered will keep boiling at 500 Watt on a 1000 watt stove. These quantities on a 2000 Watt stove will keep boiling at much lower than 1000 Watts.

To provide for some automation and help save energy as well as reduce fatigue of cooking a 'Timer Mode Cooking' feature is provided with the 'Firevoider'.

When 'Timer Mode Cooking' feature is not selected and the Stove(s) power consumption is greater than 500 Watt and the motion sensor did not sense presence of cook for 10 minutes the 'Firevoider' enters Abandoned Cooking Mode. An 80 decibel alarm is sounded and the power to the range is paused for 45 seconds. Power supply is resumed for 30 seconds and no alarm is sounded. This On-Off sequence and alarming is continued for 4 cycles and there after the Range is turned off (Shutdown).

In the event of a utility (mains power) power failure lasting longer than 110 seconds or greater the Abandoned Cooking memory will be lost. Retaining memory requires power. 'Firevoider' logic works on inputs from Motion Sensor, Smoke Sensor and timers. All these elements are expected to consume about 50 millijoules of energy per second (at the current state of development) or about 5.5 Joules for 110 seconds needing super capacitor storage of 0.11 Farad at 11 Volts. Generally the intent of storing power to retain the memory and sense hazard is to over-come power flickers. In the developed countries power failures are very rare; however, power flickers are not uncommon. Some power flickers last for a fraction of a second and this is not felt by many. Under such power flickers 'Firevoider' will remain fully energized. There are some power flickers that last for a second or two. These power flickers are rare and they are noticed by the cooking range clock requiring time reset. These power flickers are adequately handled by the 'Firevoider'. 'Firevoider can remain fully functional for up to 2 seconds after a power failure.

In the under developed countries power failures are not uncommon. 'Firevoider' system intended for these locations may be equipped with up to 0.30 Farad at 11 Volt. This higher capacity storage will, of course, add to the cost of the system.

However, after a power failure of 110 seconds or greater the heating element and as well as the cook pot will have cooled to an extent that turning the power 'On' will not enhance the hazardous situation. Since the 'Abandoned Cooking' memory only will be lost it will take another 10 minutes of power consumption above 500 Watts to activate the feature. On some rare occasions this may result in the cook pot and the food in them getting spoiled. The minimum power storage to enable the sensor and the logic activity for 110 second was decided on the requirement of the 'Low Hazard' action feature. Low Hazard action feature requires 105 seconds to complete the procedure hence keeping the sensor and analyzer circuitry enabled for 110 seconds is more than adequate to avoid a fire.

When the 'Timer Mode Cooking' is selected range power is cycled to lower the power level of all the stoves and the oven after a preset length of time not exceeding 20 minutes. Setting this feature bypasses the 'Abandoned Cooking' feature. Motion is not detected for the purpose of determining if the cooking was inadvertently abandoned.

After the expiry of the preset time range power is cycled to the level set by the cook. However, it does not allow the cook to set power levels beyond 50%. Power levels of less than 50% being safe level. At 50% power level a preheated 2 kilo watt oven maintains a temperature of at least 230 degrees Celsius, hot enough to do most of the baking. 20 minutes of full power allows for preheating to 230 degrees Celsius and the initial heating of cold food that was placed inside the oven.

Enabling the 'Timer Mode Cooking' feature does not disable the 'Extreme Hazard', 'High Hazard' and 'Low Hazard' feature as discussed later.

Patents Using Signal from Smoke Detectors

The following four patents are based on signal from smoke detectors

KITCHEN RANGE SAFETY SHUTOFF, U.S. Pat. No. 4,659,909, Issued to Arthur E. Knutson, Date of patent Apr. 21, 1987

This patent discloses that:

A smoke detector is mounted externally of but adjacent to an electric kitchen range and supplies an electrical signal when smoke is detected. Such signal actuates a relay to interrupt the supply of power to the range. The relay can be interposed between the range plug and its wall receptacle so that no modification to the internal range circuitry is required, and can require a manual resetting operation before the supply of power to the range is resumed.

This patent also discloses that a conventional smoke detector is used and that the signal is taken from the auxiliary out put line of the smoke detector.

Whereas 'Firevoider' is controlled by a 'Smoke Sensor' which operates on the same principles of a house hold ionization chamber smoke detector the interpretation of the signals by the 'Firevoider' is different, and is defined. Hence it is imperative that I discuss the Conventional Smoke Detectors vis-à-vis the Smoke Sensor of the 'Firevoider'.

Discussions of the house hold smoke detectors;

There are 2 types of house hold smoke detectors.

Ionization chamber smoke detectors contain 0.9 micro curies of Americium 241. Americium 241 is an Alfa radiator. Besides Alfa particles it emits 59.6 Key. Gama rays too. The americium radiator is contained inside a metal chamber made of about 0.5 mm thick copper. Per The National Bureau of Standards, USA recommendations the lead shield required for this strength of Gamma radiation is below zero; so a calculation for 200 Key at 10 millicurie is given below;

Required lead thickness=−0.14+0.26−0.17=−0.05 millimeter of lead. So 0.5 mm of copper is adequate to shield Gama radiation of 59.6 Key of strength 0.9 micro curies.

Alfa radiations are stopped by 5 centimeter of air or a sheet of paper. The outer container for the ionization chamber is so built that the total path of air from the radiator is greater than 5 centimeters. The wall thickness of the outer container is greater than 1 milli meter thick which is thick enough to prevent escape of Alfa particles from the radiator through the wall. Thus chances of exposure to Alfa particles are eliminated.

The Alfa radiator here ionizes the air. The Alfa radiator on a smoke detector is connected to the ground. The ionization chamber is connected to the positive (9 volt) power supply. A conducting washer is interposed in between the Alfa radiator and the chamber. This washer is connected to a sensitive electronic integrated circuit amplifier. In normal course current flows from the ground through the radiator to the chamber walls and through the conducting washer to the integrated circuit through the ionized air. The potential at the washer is generally adjusted to yield a voltage of about 50 to 55% of the supply voltage. The washer voltage can also be adjusted by connecting an appropriate resistor (millions ohms of resistance) from the chamber to ground. The current that flows in most of these smoke detectors is a total of about 1.5 Nano Amperes. The integrated circuit amplifier draws about 1 Pico ampere and amplifies this current to usable values.

When particles heavier than air molecules enter the chamber charges get attached to it. Heavier particles have greater moment of inertia. So they travel slower than the air molecules thereby reducing the flow of current and hence a reduced voltage at the washer. Since, the detector washer receives most of these heavy particles so less positive voltage is imposed up on it.

Ionization chamber 'Smoke Sensor' will show a reduced Sensor Voltage even with Carbon Dioxide and such reduction of voltage is dependent up on the number of particles and their density. For such reasons they are often tested with a spray of refrigerant. Refrigerants have molecular weights of between 100 to 120 Atomic Mass Units compared to 28 and 32 of Nitrogen and Oxygen molecules respectively. Smoke as detected by house hold ionization chamber detectors constitutes mostly of fine particles of carbon and some vapours of oil. Such smoke is available from burning fires mostly from oils and plastic. Wood has many volatile substances and so smoke from such fires is also well interpreted by Ionization chamber detectors.

Integrated circuit for ionization chamber smoke detector has a unity gain amplifier connected to the detector washer. This unity gain amplifier stage compensates for the bias current of the comparator amplifier. The comparator non inverting input is connected to a voltage divider circuit that provides the reference voltage for smoke detection. Since these devices operate on battery power this reference voltage is enabled for only 1 milli second every 1.5 seconds. When smoke is detected the reference voltage becomes available till the smoke clears.

The photoelectric detectors utilise a different technology.

In them the detectors are enclosed in a smoke chamber that obstructs light but allows smoke laden air in. It has an infrared radiator radiating at about 950 nano meter and a photodiode that is optimised to detect 950 nano meter light waves. The infrared LED and the photo diode are arranged so that direct light from the LED does not reach the diode. The wall of the chamber is made such that it reflects the bare minimum amount of infrared. Pulsating DC current is imposed up on the LED. The LED emits a train of pulsating light when this light falls on a particle it is reflected and refracted and reaches the photo diode where it generates a current in the photodiode. A set of integrated circuit amplifiers converts the current to a pulsating DC voltage. An integrator integrates them and over a preset length of time. This integrated voltage is sent to a comparator that trips an alarm. Since light has to reflect there have to be large enough surface area. And hence, photoelectric detectors can detect solid particles if they have large enough sizes or a large amount of small smoke particles. They are suitable to detect smoke particles from a smouldering fire. They detect smoke particles from a burning fire if the particle count is high.

Since these devices operate on battery most Integrated circuits for photoelectric detectors are programmed to enable the circuit for 100 micro seconds in every 10 seconds or so and to keep them continuously enabled if smoke is detected and till smoke clears.

In general the house hold smoke detectors are located under the ceiling and never near a kitchen. In comparison to the fire that they are expected to locate their physical locations are remote. So they are adjusted for very high sensitivity. After all a false alarm can be a bother but a delayed alarm can be a catastrophe.

Both the smoke detectors were tried at various locations in and around the kitchen. Photoelectric smoke detectors failed to give ratio metric output and so they were excluded from the trials.

On trials it was observed that the back of the Cooking range was a smoke blind spot. Fan powers of up to 20 Watt failed to adequately aspirate the detector at range back Switch panel and below. However, in all trials the smoke detectors received ample smoke when placed up to 20 centimeters below the range hood exhaust filter. A very convenient location for the smoke sensor was the front rim of the range hood exhaust however placing the smoke detector on the front end of the range hood would result in a clutter of wire. Clutter could be reduced by wireless connection that would not only require costly wireless apparatus but would have to be battery powered. As has been observed human psychology is such that, battery cost (particularly for a safety device) at even 1% the cost of the equipment per annum is costly. Thus batteries are rarely replaced in safety devices.

So the wall at the back of the range (clamped under the range hood exhaust filter in extreme cases) was chosen to try the smoke Sensor. This location yielded very satisfactory results. The clutter of wire is just a small diameter 3 wire connector that runs straight down and is connected to the 'Sensor Panel'.

The smoke detector of 'firevoider' is called a 'Smoke Sensor' for it senses the smoke levels and does not merely detect presence and absence of smoke. Extensive measurements yielded a detector plate (washer) potential at zero (ambient) smoke of between 4.5 to 5 volts as ideal.

Properties of various oils and fats were researched. The various terms for the relevant properties are stated and defined below;

TABLE 2

| | |
|---|---|
| Fire point | Is the temperature, of fuel, at which it will continue to burn after ignition for at least 5 second. Oils and fat have a fire point greater than 300° Celsius (auto ignition points are between 340° to 350° C.). |
| Flash Point | This temperature is lower than that of the fire point. The oil will ignite but vapour may not be produced in substantial quantity to sustain the fire. On removal of the source of heat, the flame will extinguish. Flash point represents the temperature at which the vapour pressure reaches the lower flammability limit. This is an empirical parameter which is measurable for only a few oils like Palm oil. |
| Smoke point | This is the temperature at which the decomposition products of oil become visible. This temperature for various oils varies from around 105° to about 275° Celsius for various oils and fat. Unrefined oil has lower smoke point than refined oil. Also refined oils at the beginning of the fry have a higher smoke point than after the frying starts. This temperature is much lower than the flash point of oils and fats. |

Research and extensive trials revealed that for the purpose of designing the 'Firevoider' Palm oil, Ghee (Clarified butter) and highly hydrogenated vegetable oil were the riskiest. The difference between the smoke point and flash point (smoke point of Palm oil is around 230° Celsius and flash point is 230° to 250° Celsius) for these oils is marginal. Besides they do not emit recognisable smoke below 130° Celsius. Refined and unrefined oils emit recognisable smoke at much lower temperatures and hence are safer than Palm oil, Ghee, and highly hydrogenated vegetable oils.

Trials on these oils yield the following results;

A sample of 80 milli liter of oil was found to be a safe amount. 80 milli liters of various oils were heated on various stove elements and were ignited when fuming. The flame was observed not to spread beyond the area covered by the Range Hood Exhaust. The flames were subjected to a blow from house hold pedestal fan. The flame failed to spread beyond the area under the range hood exhaust. Situation was better with the range hood exhaust fan on. The soot that deposited on the range hood and the wall around could be cleaned using house hold detergent and water with minimal effort.

Larger quantity of oil takes longer to heat and hence 80 milli liters of oil was used for determining various time parameters.

80 milli liter of Aseel Ghee was heated on a thin aluminum pan. The pan was put on a stove that had been 'On' for long enough to achieve steady state temperatures.

Smoke Sensor zero smoke Sensor Voltage set to 5 Volt

TABLE 3

| Heating Time | Temp | Smoke Sensor Voltage | Consequences | Affect on Food |
|---|---|---|---|---|
| 30 seconds | 110° C. | 4.95 Volt | Nothing to report | |
| 50 seconds | 140° C. | <4.5 Volt | Nothing to report | Fries Ok |
| 110 seconds | 180° C. | <3.5 Volt | Nothing to report | Fries OK |
| 170 seconds | 200° C. | <2.6 Volt this is below 55% Sensor Voltage and is interpreted by the 'Firevoider' as dense smoke | Dense smoke | Begins Charring |
| 180 seconds | >200° C. | <2.5 Volt | Nothing more to report | Rapid Charring |
| >200 seconds | >210° C. | 2 to 0.6 Volt | Nothing more to report | Rapid Charring |
| >230 seconds | >220° C. | 2 to 0.6 Volt | Dense, Acrid Smoke | Almost Charred |

Theses trials were conducted on various oils, namely, olive, mustard, corn, canola, safflower, sunflower, margarine, butter, clarified butter (Ghee), palm and cocoanut. All these oils were detected earlier than that of Aseel Ghee (a highly hydrogenated vegetable oil).

Based on these observations the time periods and smoke levels were defined. And the logic for combination of Smoke Signal with Motion Sensor out put was determined.

High Hazard and Extreme Hazard functions were introduced to rectify misdetection of presence by motion sensor. A ten minute bypass of the High Hazard feature was introduced to reduce interference in cooking.

TABLE 4

| | | |
|---|---|---|
| Hazard Clear | >90% Sensor Voltage | |
| Oil on stove | <90% Sensor Voltage | |
| Low Hazard | <75% Sensor Voltage | Action activated 30 plus 5 seconds after absence of cook |
| High Hazard | <55% Sensor Voltage | Action activated 5 seconds after in presence of cook but can be bypassed for 10 minutes on each instance |
| Extreme Hazard | <55% Sensor Voltage | Action activated 5 seconds after absence of cook |

Patents Housing an Interrupter in an Enclosure and Using Signal from Smoke Detectors The following three patents are based on signal from smoke detectors and also disclose the use of an interrupter enclosed in an enclosure.

METHOD AND APPARATUS FOR REMOTELY CONTROLLING DEVICES IN RESPONSE TO A DETECTED ENVIRONMENTAL CONDITION, U.S. Pat. No. 6,130,412 issued on 10 Oct. 2000 to Charles Timothy Sizemore This patent discloses that:

'A method is disclosed for detecting a condition indicative of fire or elevated potential for fire, broadcasting a signal in response to its detection and for operating various controlling devices in response to the broadcast signal in order to enable or disable valves or appliances connected to a power supply through the controllers. Also disclosed is a system having a sensor, a transmitter responsive to the sensor, a receiver for receiving signals from the transmitter and controllers responsive to a signal from the receiver for controlling devices in accordance with the method of the invention. Each of the controllers is shifted from its normal position upon the receipt of a signal from any one of the sensors, and more than one controller device may be controlled by a given receiver. Multiple sensors each capable of detecting a different condition, indicative of fire or elevated potential for fire such as the presence of smoke or strong vibration, can be used in a single system for activating all controller devices upon the detection of a condition indicative of fire or elevated potential for fire.'

This invention discloses the use of a Smoke Alarm (gives the example of 'Lifesaver Smoke Alarm Model-1255 manufactured by South West Laboratories Inc.) that transmit signals in response to the presence of smoke.

Patents Housing an Interrupter in an Enclosure and Using Signal from Smoke Detectors Whose Spirit is Based on Power Isolation to Reduce Damage The following two patents are based on signal from smoke detectors and also disclose the use of an interrupter enclosed in an enclosure. Their spirit is based on the assumption that isolation of power can reduce the extent of fire damage SAFETY SHUT-OFF SYSTEM, Canadian unexamined patent application #2455665 inventor Schoor, Wolfgang, Open to public inspection since 22 Jul. 2005

This patent discloses that:

A safety shut-off system controls power supply to an appliance to prevent accidental fires and the like. The shut-off system includes a shut-off switch for connection in series with the power supply of the appliance. A controller opens the switch in response to detection by the detector of a prescribed fire condition. Failsafe means are provided on the controller for opening the shut-off switch in response to a malfunction of the detector to ensure that the appliance is only permitted to operator under safe conditions when the detector is properly operating. In order to avoid false alarms the detector may take various forms including the detection of sound or other conditions which may be indicative of a potential fire. There are also incorporated switching capabilities to control additional a/c outlets, gas, propane and other appliances which work in unison with this system.

As defined in the discloser the triggering fire conditions include

Typical fire detectors note abnormal environmental conditions such as the presence of smoke or an increase in temperature, light intensity, or total radiation. Detectors for this purpose operate on principles involving thermal expansion, thermoelectric sensitivity, thermo conductivity, or photosensitivity. Of special interest in the present invention is that a specific sound is associated with cooking grease fires, therefore, a sound detector is incorporated into the system. The sound detection assists in eliminating false alarms as a result of non-threatening and minor occurrences (from a toaster for example) to the environment as mentioned.

Although the disclosers by Schoor in this invention do not specifically claim the prescribed fire condition as detection of presence of smoke, however, in the accompanied detailed descriptions, at page 4 line 10 it states;

The controller also provides power to a relay 28 which relays an alarm signal from a detector 30 of the system. The detector 30 may comprise a conventional smoke detector for producing an alarm signal in response to heat, ionization, smoke or any combination thereof.

Over here the discloser suggests the use of conventional smoke detectors that transmit signals in response to the presence of smoke.

SAFETY SHUT-OFF SYSTEM, U.S. Pat. No. 7,327,246 B2 issued on 5 Feb. 2008 to Wolfgang, Schoor This patent discloses that:

A safety shut-off system controls power supply to an appliance to prevent accidental tires and the like. The shut-off system includes a shut-off switch for connection in series with the power supply of the appliance. A controller opens the switch in response to detection by the detector of a prescribed fire condition. Failsafe means are provided on the controller for opening the shut-off switch in response to a malfunction of the detector to ensure that the appliance is only permitted to operator under safe conditions when the detector is properly operating. In order to avoid false alarms the detector may take various forms including the detection of sound or other conditions which may be indicative of a potential fire. There are also incorporated switching capabilities to control additional a/c outlets, gas, propane and other appliances which work in unison with this system.

As defined in the discloser the triggering fire conditions claimed in claim 18 states;

The system according to claim 16 where in the prescribed fire condition includes elevated temperatures, ionization of air, smoke which blocks the light transmission through air, sound indicative of a fire about to start or any combination there of.

Although the disclosers by Schoor in this invention do not specifically claim the use of a smoke detector, however, in the accompanied detailed description, at page 2 line 50 it states;

The controller also provides power to a relay 28 which relays an alarm signal from a detector 30 of the system. The detector 30 may comprise a conventional smoke detector for producing an alarm signal in response to heat, ionization, smoke or any combination thereof.

Over here the discloser suggests the use of conventional smoke detectors that transmit signals in response to the presence of smoke.

CONTROLLER FOR A SAFETY SHUT-OFF SYSTEM, World Intellectual Property Organization—International publication #WO2009/021330 A1 AND International Application #PCT/CA2008/001462, Inventor BUTT, Marvin D.

This patent discloses that:

A controller for a safety shut-off system is taught. The controller is for a system that interrupts a supply of electricity to an electrical appliance upon detecting a trigger. The controller includes a housing having a cover with an electrical socket, which is configured to receive an electrical plug electrically coupled to the appliance. The controller also includes interrupter circuitry contained within the housing, which is electrically coupled to a power supply and to the socket, and which is configured to decouple the power supply from the socket upon receiving a trigger signal. The trigger signal is generated in response to a safety hazard associated with the electrical appliance.

Benefits of the afore-described embodiments arise from the fact that a standard circuit box, such as those manufactured by the Leviton family of companies, can be used for both wireless and wired embodiments of the invention. This results in lower manufacturing costs, as the same housing can be used for both wireless and wired embodiments of the controller and the housing is inexpensively available commercially as an off-the-shelf component, thus lowering its price. Additionally, when installing the controller, a consumer does not need to cut a hole in dry wall, but instead can simply swap an existing standard circuit housing for the same type of housing containing the controller. Both benefits reduce the time, effort, and money that need be expended by consumers, and consequently increase the likelihood that consumers will adopt the invention.

The discloser discusses that

According to one embodiment of the invention and referring to FIG. 1A, a safety shut-off system 10 whose components are connected wirelessly is shown. In the embodiment of FIG. 1A, the system 10 comprises a smoke detector 14 and a wireless transmitter housed therein (not shown), a panic/reset button 12 and a wireless transmitter housed therein (not shown), a standard circuit box 26 and a controller 20 housed therein, an AC power source A, and an electric appliance 18. While in this embodiment the use of a smoke detector is taught, other hazard detectors, such as tremor detectors that detect earthquakes, could also be used. During normal operation, the appliance 18 is plugged into the circuit box 26 and the controller 20 allows electricity to be conducted from AC power supply A to the appliance 18. The housing of the controller 20 comprises a standard Leviton™ circuit box, or any other suitable and commercially available circuit box, fits within a wall and is flush with the exterior of the wall. Characteristics of a suitable circuit box include that it should satisfy any applicable building regulatory requirements and should have a front cover that is removable and that allows for easy access to the interior of the box. An exemplary circuit box is a Leviton™ 1279-001 receptacle, which measures 4 11/16' long×4 11/16' wide×2 1/8' deep. Exemplary wireless smoke detectors 14 include the ADEMCO 5806 detector, the Securel inc. (73942) detector, and the Wisdom 433 Mhz Wireless Smoke Detector.

If the detector 14 detects the presence of smoke, then in the wireless embodiment illustrated in FIG. 1 an RF signal 15 is transmitted and is received by the controller 20. Upon receiving the signal, the controller interrupts the AC power supply to the appliance 18 and consequently shuts the appliance 18 off. With the appliance 18 shut off, the energy that would otherwise act as an accelerant for the fire is eliminated, and the progress of the fire is slowed. While the fire is not actively extinguished by the safety shut-off system, by slowing the progress of the fire the system helps to minimize fire damage. In the case of a false alarm, or when the danger posed by the fire has passed, a user can press the panic/reset button 12, which will transmit an RF signal 13 to the controller 20, and the controller 20 will restore the AC power supply to the appliance 18.

In all the above 3 inventions the spirit is based on the assumption that the effects of a fire can be reduced by turning 'Off' the source of heat. Further more the assumption is made that presence of smoke means presence of fire or imminent fire. The presence of smoke is detected by standard Smoke Detectors (that transmit signals in response to the presence of smoke and do not measure the level of smoke) available in the market that provide the trigger for interrupting power.

The various aspects of the effect of a heat producing stove element on that of a burning fire and of triggers by a standard Smoke Detector and its interference with cooking are discussed below;

The idea that by turning off the heat the fire hazard can be reduced has been disclosed. As I have already discussed 80 milliliters of oil is considered safe for the fire is contained within the general area of the range hood exhaust. This amount of oil takes about 3 minutes to burn.

80 milli liters of oil has an energy content of about 3250 KJ. The smallest heat source that can cause a fire is 650 watts from a 1000 Watt Stove.

Rate of release of heat from 80 ml of oil is 14 KJ per second. The stove out put at 650 Watt is 0.65 KJ per second.

With a larger heater say 2500 Watt the output will be 2.5 KJ per second which is only 18% of the rate of release of energy from 80 milli liters of burning oil. With larger quantities that can cause significant damage the proportion of heater heat input is minimal. Hence turning off the heat after the oil is ignited will not achieve any purpose. The source of heat has to be turned off a safe time before the oil ignites.

all Cooking Invariably Involves Oil and a Little Smoke Also.

Even when a pan containing a smear of oil and filled with water goes on the stove and starts boiling the Firevoider Smoke Sensor voltage goes below 90%. When a pan containing a spoon full of oil like mustard, corn, olive, margarine and the like and filled with water goes on the stove and starts boiling the Firevoider Smoke Sensor voltage goes below 80% and below the voltage at which all available smoke detectors trip the alarm.

Fried things invariably make up the great proportion of dishes excluding the staple (bread, rice), for they taste better. Any frying will register a 'Firevoider' Smoke Sensor Voltage well below 75%. Hard frying small fish emits a lot of smoke and this smoke registers a Firevoider Smoke Sensor Voltage below 55%. These situations indicate the possibility of imminent fire which do not exist in presence of an attentive cook. This definitely is a false alarm of High Hazard and so 'Firevoider' allows the cook to disable High Hazard function for up to 10 minutes on each instance. However, experiments indicate that the imminence of fire is at least 1 minute away and the food begins charring. The cook who is attentively present will definitely not let the food char and will take action. If the cook is not very attentive the motion sensor logic will conclude that the cook is absent and Extreme Hazard action will be taken in 5 seconds. Thus the chances of a fire incident are greatly reduced.

Firevoider does not enable any of its monitoring features at low power levels. Power consumption levels below 500 Watt have proved to be safe under all circumstances and hence there is no need to monitor such situations.

The 'Firevoider' Logic at Length

'Firevoider' uses the logic that; 'A stove consuming less than 50% its rated power is ordinarily incapable of igniting oil on a pan and hence incapable of causing a fire accident. If the oil being heat on the stove does not produce oil vapour or smoke in adequate quantities the chances of the oil getting ignited and starting a fire are remote. Inactivity of the cook in front of the stove indicates mental preoccupation hence the cooking is not being attended to. Also if the cook is present and attentive then the cook being a human (the master) is more intelligent than 'Firevoider' a machine (the slave). Once the oil is ignited it will keep burning till all available oil is exhausted and that the stove power input is insignificant compared to the power of the burning oil.'

The logic used in a 'Firevoider' to determine the proximity of an imminent fire results in an artificial intelligence. 'Firevoider' is capable of making decisions on the imminence of fire and act as necessary. The only time it can go wrong is when it is not in working order or when the cook has turned off the High Hazard feature and is present and actively present in front of the range and is able to withstand the acrid smoke that is emitted after the oil reaches smoke point. The probability of such situation is insignificant.

Feasibility of Controlling Power to an Electric Cooking Range by Utilising an Interrupter Housed in an Unventilated Miniature Enclosure.

Miniature circuit breakers are available and can interrupt power supply. They are a replacement for the fusible fuse. They can be activated by heating the bi-metallic element in it or by passing a momentary large current through the circuit. However, they have very limited life—may be a few hundred or so cycles. Besides they have to be manually reset.

The other group of interrupters are the electromechanical relays. These can handle large currents and can be activated remotely both for breaking and restoring power supply, the current needed for their control is a short pulse of a couple of milli amperes which is within the capability of most small and miniature electronic circuits. These have large enough lives of a couple of thousand cycles. However, they are bulky, heavy and noisy.

Electro mechanical relays can not fit in to the enclosures shown in U.S. Pat. No. 6,130,412 and World Intellectual Property Organization Publication # WO2009/021330 A1.

They can fit into U.S. Pat. No. 7,327,246 B2 and Canadian unexamined Patent #2455665. However, as depicted and disclosed that they can be plugged into a range power outlet is not feasible. This idea of plugging the interrupter apparatus into the outlet and let it suspend from it comes from the various power adapters and battery chargers. These small devices draw very little current and hence a lose contact may not be of concern. The most common electric cooking range draws a full load current of 38.5 Amperes and upscale models draw up to 55 Amps at 115 Volt double phase. Such high currents with a lose contact can be a major Electrical and Fire hazard and in no jurisdiction will their use be legally permitted. Now for such reasons such heavy devices may be permanently fixed to the wall or a recess in the wall.

The only device presently available to interrupt large electric current (other than a fusible fuse) and of small dimensions and weight is the electronic relay. These relays suitable for use with a cooking range typically measure 57.15×44.45×23.62 and emit 0.9 Watts per ampere conducted through it. Hence provision has to be made to cool them.

Discussed below is the cooling arrangement and heat balance of the 'Firevoider' meant for locations with climatic maximum temperatures of 30° C. and below.

Heat capacity of the heat sink and the box 400 Joules per ° C.

Fan set to start at 65° C. heat sink temperature

Kitchen ambient 25° C.

Ambient temperature behind the range 30° C.

Heat out put with a load of 2000+1000 Watt 13 Watt

Heat out put by various circuitry 1 Watt

Time required for the heat sink to reach 65° C. 15 minutes

Cooling rates of various elements

Radiation from heat sink and other elements at 65° C. 3 Watt

Replacement of air inside the panel due to stack effect and heat removed due to stack effect at 65° C. 3 Watt Others (by conduction through the box and the like) 1 Watt Total cooling capability without fan 7 Watt Heat out put from 11400 Watt cooking range with full load 50 Watt Heat sink cooling rate with fan on at full load 1.04°/C Equilibrium temperature of heat sink with fan on 74° C.

Electronic relay manufacturers recommend a maximum heat sink temperature of 75° C. at full load. Hence, the heat sink temperature can not exceed 75° C. and at least 1° C. is required for manufacturing tolerance.

Discussed below are the components that decide the size of the 'Firevoider' meant for locations with climatic maximum temperatures of 30° C. and below.

The range power outlet is a passive device. Passive devices last very long. Properly installed range power outlets can last a lifetime or longer.

Any controlled power interrupter is an active device. Active devices will break down if not earlier then at the end of their life and without any prior indication. The general life expectancy of electronic devices is 10 years.

For such reasons it will be greatly inconvenient if an electronic device replaces the range power outlet, the device fails and at mid night the range is not available because the outlet has failed and because it is an electronic device. Hence the interrupting device has to be in addition to the range power outlet. Thus the existing range power outlet and 'Firevoider' have to be connected in parallel.

Parallel connection can be done by running a set of (costly) dedicated conductors from the electrical supply service panel or from a secondary panel which has an appropriate bus bar for such purposes. The 'Firevoider' main panel houses an appropriate bus bar (FIG. 2) for such purposes. The conductors can run from the service panel to this bus bar and then from here to the existing outlet and the 'Firevoider' relay and power outlet. Also when the 'Firevoider' is not installed on the wall (or in a recess cut in the wall) it can be connected to the existing outlet by using an appropriate electric cord. Such a cord can be connected at the bus bar and would be allowable.

The most efficient heat sink at 1° C./Watt suitable to be located inside a 55 mm deep box, on which a suitable electronic relay is mounted will measure about 100×100×20 MM.

There has to be an opening for letting in cooling air. This inlet has to have a filter to filter out dust. Dust (in large quantities) will not only reduce the cooling capacity of the heat sink but also can result in malfunctioning of the electronic components. A filter thus can reduce service requirement of the 'Firevoider'. An inlet with a good filter to let in about 2 cubic meters of air per minute is about 6 cm square.

To accommodate a bus bar, heat sink (1° C./W), a range power outlet and filter the minimum requirement of an enclosure is about 200 mm wide, 200 mm broad and 55 mm deep. Hence the 'Firevoider' Main Panel size varies from 200×200×60 mm (for climatic maximum below 25° C.) to 250×250×60 mm (for climatic maximum up to 50° C.).

The invention claimed is:

1. A device for regulating power to a cooking appliance, comprising:

a control module interposed between an electrical power source and the appliance, the control module being operable to regulate electrical current to the appliance from the power source, wherein said electrical current regulation comprises at least one of reducing the electrical current, cycling the electrical current and cutting off the electrical current to the appliance;

a smoke sensor positioned in a path of smoke generated during use of the cooking appliance, the smoke sensor being operable to measure a level of smoke indicative of a risk of fire; and a motion sensor operably positioned to detect one of human presence and human absence of an appliance operator;

whereby, when the smoke sensor measures a first range of smoke level, electrical current regulation is not performed;

whereby, when the smoke sensor measures a second range of smoke level and the motion sensor detects human absence for a first pre-selected period of time, the control module regulates the electrical current to the appliance;

whereby, when the smoke sensor measures a third range of smoke level and the motion sensor detects human absence is detected by the motion sensor, the control module regulates the electrical current to the appliance; and whereby, when the smoke sensor measures the third range of smoke level and the motion sensor detects human presence for a second pre-selected period of time, the control module regulates the electrical current to the appliance.

2. The device according to claim 1, wherein the motion sensor comprises a pyroelectric infrared sensor and a fresnel lens having a vertical pattern; whereby horizontal motion integrated over 1 second being greater than 60% is interpreted as human presence and horizontal motion integrated over 1 second being less than 20% for a period of 5 seconds is interpreted as human absence.

3. The device according to claim 2, wherein the pyroelectric infrared sensor is configured for sensing 5 μm to 14 μm infrared radiation, the first pre-selected period of time being between 25 to 35 seconds, and the second pre-selected period of time being 5 seconds.

4. The device according to claim 3, wherein the smoke sensor comprises an ionization chamber smoke sensor having a pre-selected zero smoke level voltage; and wherein the first range of smoke level comprises a voltage drop range from the zero smoke level voltage being greater than 75%, the second range of smoke level comprises a voltage drop range from the zero smoke level voltage being between 75% to 55%, and the third range of smoke level comprises a voltage drop range from the zero smoke level voltage being less than 55%.

5. The device according to claim 4, wherein the cooking appliance comprises an electric cooking range.

6. The device according to claim 5, further comprising an audible alarm, wherein said alarm is activated during the electrical current regulation.

7. A device for regulating power to an electrical range cooking appliance, comprising:

a control module for regulating electrical current to the appliance from a power source;

a power sensor for detecting power consumption by the appliance, wherein the control module is activated when the detected power consumption is greater then a pre-selected threshold;

a smoke sensor operably connected to the control module, the smoke sensor being configured to measure a first range of smoke level and a second range of smoke level;

a pyroelectric infrared motion sensor operably connected to the control module and being configured to detect the presence of an appliance operator, wherein the motion sensor is operable to detect one of human presence being horizontal motion integrated over 1 second of greater than 60% amplitude and human absence being horizontal motion integrated over 1 second being less than 20% amplitude for a period of 5 seconds;

wherein, the control module regulates the electrical current to the appliance when at least one of the first range of smoke level and human absence for a first pre-selected period is detected, the second range of smoke level and human absence is detected and the second range of smoke level and human presence for a second pre-selected period of time is detected.

8. The device according to claim 7, wherein the motion sensor is configured for sensing 5 μm to 14 μm infrared radiation, the first pre-selected period of time being between 25 to 35 seconds, and the second pre-selected period of time being 5 seconds.

9. The device according to claim 8, wherein the smoke sensor comprises an ionization chamber smoke sensor having a zero smoke level voltage; and wherein the first range of smoke level comprises a voltage drop range from the zero smoke level voltage being between 75% to 55%, and the second range of smoke level comprises a voltage drop range from the zero smoke voltage being less than 55%.

10. The device according to claim 9, wherein the motion sensor comprises a fresnel lens having a vertical pattern.

11. The device according to claim 7, further comprising an audible alarm, wherein said alarm is activated during electrical current regulation.

12. The device according to claim 7, wherein the preselected threshold is 500 watts.

* * * * *